US005689886A

United States Patent [19]

Yeh

[11] Patent Number: 5,689,886

[45] Date of Patent: Nov. 25, 1997

[54] TOOL ASSEMBLY

[76] Inventor: Shih-yuan Yeh, No. 2-4, Chenhsing Rd., Taiping Hsiang, Taichung Hsien, Taiwan

[21] Appl. No.: 661,295

[22] Filed: Jun. 13, 1996

[51] Int. Cl.[6] ..... B26B 1/08; B26B 11/00

[52] U.S. Cl. ..... 30/162; 30/146; 7/129

[58] Field of Search ..... 30/123, 146, 162, 30/335; 7/158, 167, 118, 129

[56] References Cited

U.S. PATENT DOCUMENTS

| | | | |
|---|---|---|---|
| 4,783,867 | 11/1988 | Tsao | 7/160 |
| 4,794,692 | 1/1989 | Wang | 30/123 |
| 5,142,721 | 9/1992 | Sessions et al. | 7/128 |
| 5,430,940 | 7/1995 | Lym | 30/146 |

FOREIGN PATENT DOCUMENTS

| | | | |
|---|---|---|---|
| 2017559 | 10/1979 | United Kingdom | 30/162 |

*Primary Examiner*—Hwei-Siu Payer

[57] ABSTRACT

A tool assembly includes a housing having two side walls each having an inner face and an outer face. At least one of the two side walls has an elongate slot vertically defined therein. An upper recess and a lower recess are defined in upper and lower portions of the at least one side wall. A blade is mounted on the inner face of the at least one side wall. A control member is mounted on the outer face of the at least one side wall and is slidable along the elongate slot. The control member includes a stub detachably received in one of the upper and lower recesses. A biasing member includes a pressing portion urged on the stub and an abutment rested on the at least one side wall in the elongate slot. A positioning member extends through a hole defined in the control member, the biasing member, and the elongate slot, and is securely engaged in a bore defined in the blade.

5 Claims, 5 Drawing Sheets

TOOL ASSEMBLY

FIELD OF THE INVENTION

The present invention relates to a tool assembly, and more particularly to a tool assembly with an automatic positioning function.

BACKGROUND OF THE INVENTION

A conventional tool is shown in FIG. 5. However, there still remain shortcomings therein. There will be a complete illustration in the detailed description of the preferred embodiments concerning the conventional tool.

The present invention has arisen to mitigate and/or obviate the disadvantages of the conventional tool.

SUMMARY OF THE INVENTION

The primary objective is to provide a tool assembly with an automatic positioning function.

In accordance with one aspect of the present invention, there is provided a tool assembly comprising a housing having two side walls each having an inner face and an outer face. At least one of the two side walls has an elongate slot vertically defined therein and communicating with a chamber of the housing. An upper recess and a lower recess are defined in upper and lower portions of the at least one side wall and communicate with the elongate slot respectively.

A blade is received in the chamber and is mounted on the inner face of the at least one side wall. A bore is transversely defined in the blade and communicates with the elongate slot.

A control member is mounted on the outer face of the at least one side wall and is slidable along the elongate slot. A stub is formed on the control member and is detachably received in one of the upper and lower recesses. A hole is defined in the control member and aligns with the bore.

A substantially V-shaped biasing member is received in the elongate slot and abuts between the blade and the control member. The biasing member includes a pressing portion urged on the stub and an abutment rested on the at least one side wall in the elongate slot.

A positioning member extends through the hole, the biasing member, and the elongate slot, and is securely engaged in the bore.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 5:
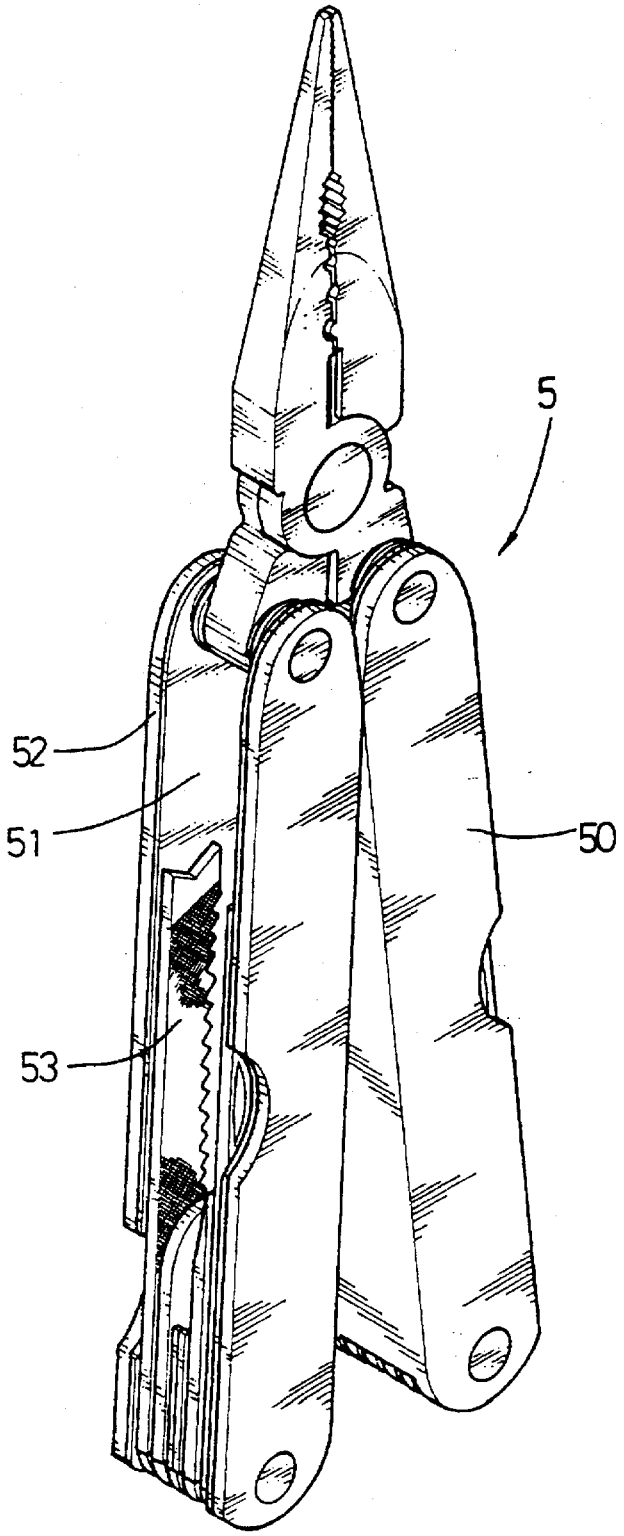
FIG.5 PRIOR ART
FIG. 5 is a conventional tool in accordance with the prior art.

For a better understanding of features and benefits of the present invention, reference is made to FIG. 5 showing a conventional tool such as a pair of pliers 5 and the like.

The pair of pliers 5 comprises two handles 50 each having two side walls 52 with a compartment 51 defined therebetween, and a plurality of blades 53 pivotally received in the compartment 51.

However, by such an arrangement, the blade 53 is not 10, securely positioned and can be rotated freely when it is pivoted relative to the associated handle 50 to reach an extended position for use such that the blade 53 is easy to fold back when a large force is applied on the blade 53, thereby greatly causing an inconvenience in use of the blade 53 and even easily injuring a user.

Figure 1:
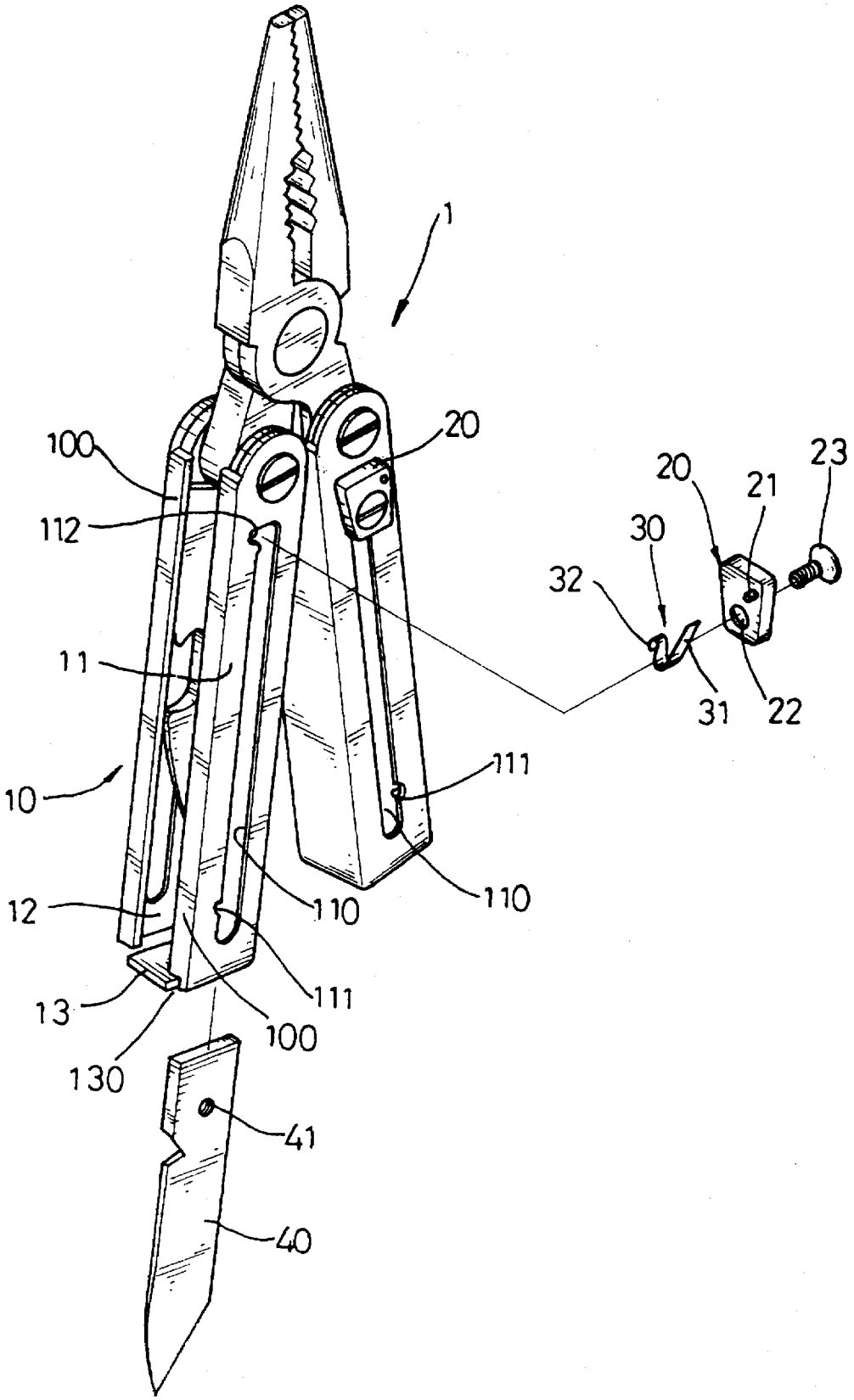
FIG. 1 is an exploded view of a tool assembly for a pair of pliers in accordance with the present invention.
Figure 2:
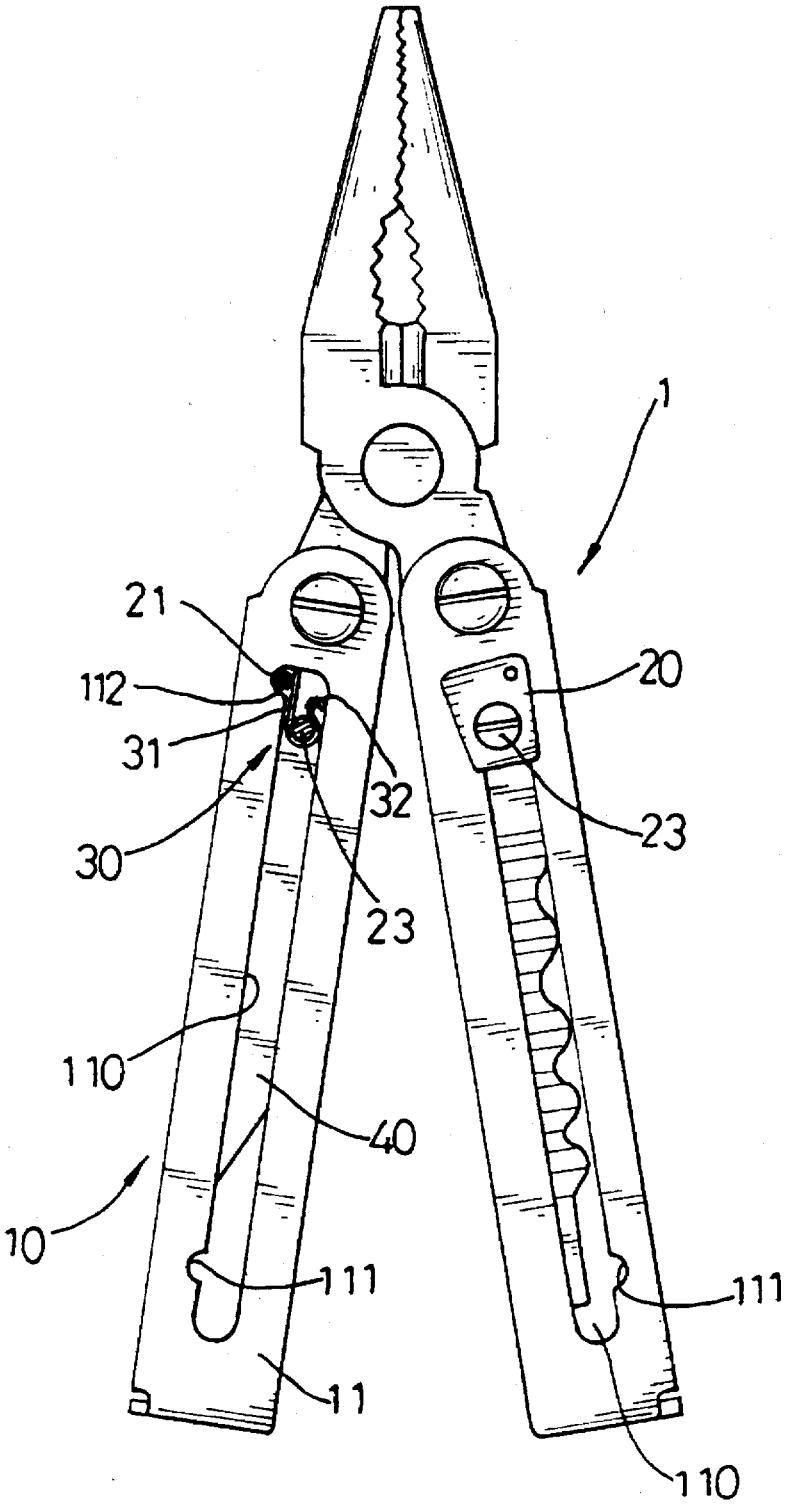
FIG. 2 is a front plan partially cross-sectional view of FIG. 1.
Figure 3:
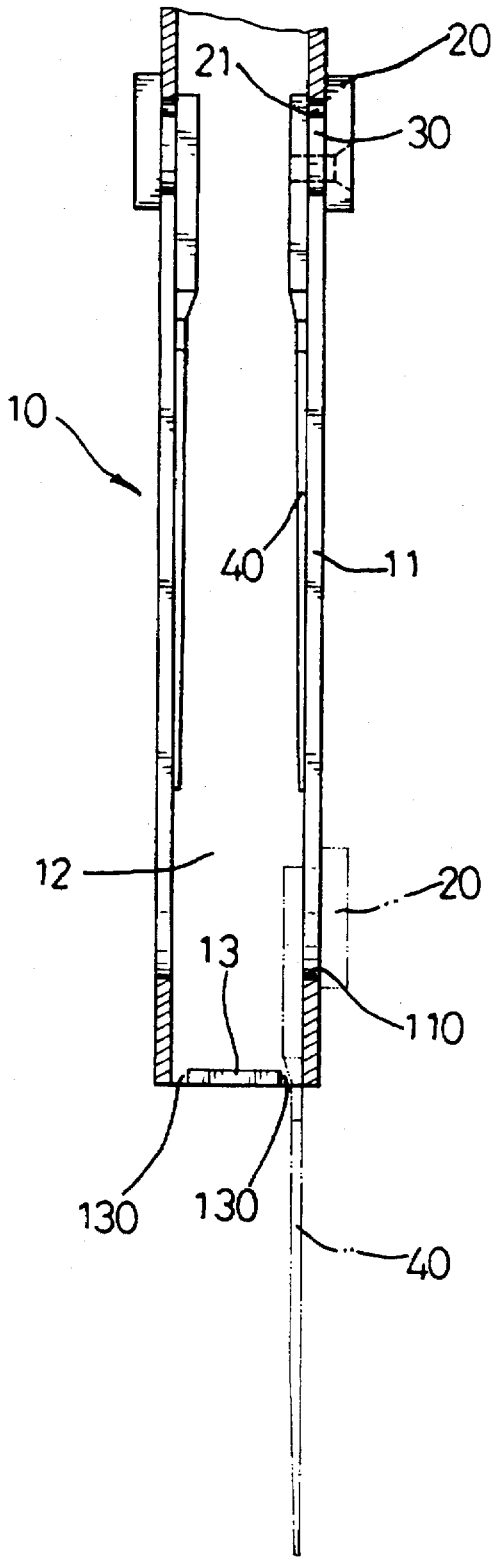
FIG. 3 is a partially cross-sectional side view of FIG. 1.

Referring to the remaining drawings, and initially to FIGS. 1–3, a tool assembly in accordance with the present invention can be adapted to function as a handle of a pair of pliers 1 and the like or can be suitable for a pocket knife.

The tool assembly comprises a housing 10 having two side walls 11 each having an inner face and an outer face. A chamber 12 is defined in the housing 10. Each of the two side walls 11 has an elongate slot 110 vertically defined therein and communicating with the chamber 12. An upper recess 112 and a lower recess 111 are defined in upper and lower portions of each of the two side walls 11 and communicate with the elongate slot 110 respectively.

The housing 10 includes a base plate 13 having a passage 130 defined between the base plate 13 and each of the two side walls 11 and communicating with the chamber 12. In addition, each of the two side walls 11 includes an upright shoulder 100 formed on one side thereof and disposed perpendicularly to the associated side wall 11.

A blade 40 is received in the chamber 12 and is mounted on the inner face of each of the two side walls 11. A bore 41 is transversely defined by a threaded periphery of the blade 40 and communicates with the elongate slot 110.

A control member 20 is mounted on the outer face of each of the two side walls 11 and is slidable along the elongate slot 110. The control member 20 includes a stub 21 protruding inwardly therefrom and detachably received in one of the upper and lower recesses 112 and 111. A hole 22 is defined in the control member 20 and aligns with the bore 41.

A substantially V-shaped biasing member 30 is received in the elongate slot 110 of each of the two side walls 11 and abuts between the blade 40 and the control member 20. The biasing member 30 includes a resilient pressing portion 31 urged on the stub 21 and an arcuate abutment 32 rested on each of the two side walls 11 in the elongate slot 110.

A positioning screw 23 extends through the hole 22 of the control member 20, the biasing member 30, and the elongate slot 110 of each of the two side walls 11, and is threadedly engaged in the bore 41 of the blade 40.

Figure 4:
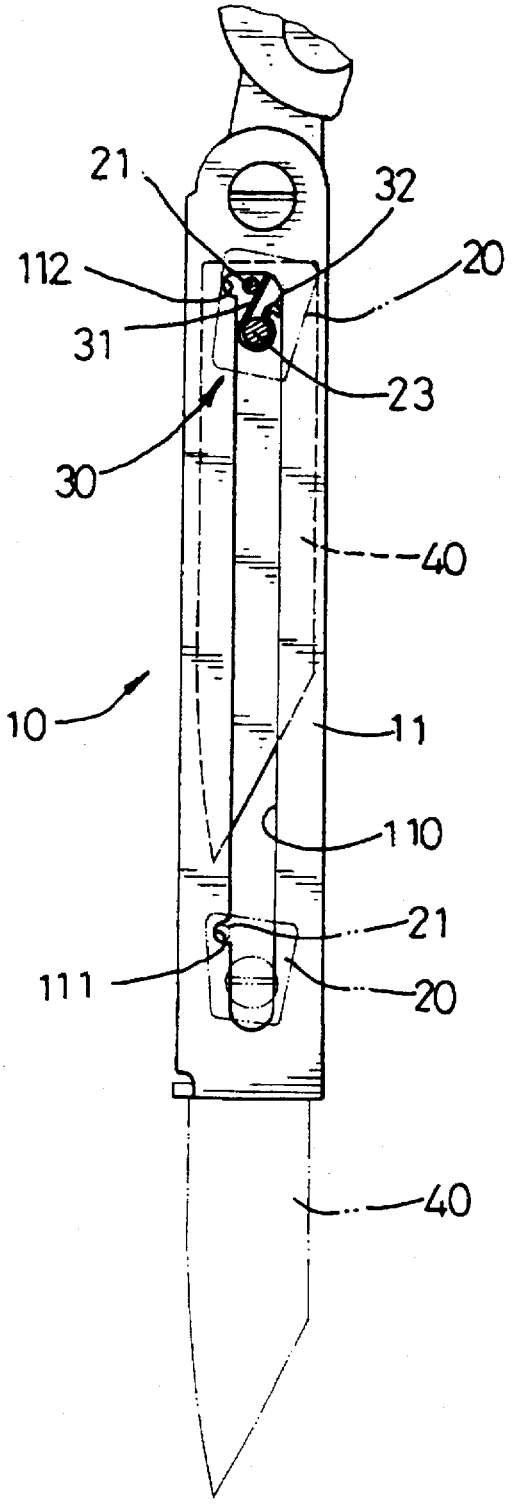
FIG. 4 is a partially cross-sectional front plan operational view of FIG. 1.

In operation, referring to FIGS. 3 and 4 with reference to FIGS. 1 and 2, the stub 21 of the control member 20 is initially urged to be received in the upper recess 112 by means of the pressing portion 31 of the biasing member 30 whose abutment 32 is rested on the associated side wall 11 as shown in FIG. 2.

Then, the control member 20 can be rotated relative to the housing 10, thereby moving the stub 21 to compress the pressing portion 31 of the biasing member 30 and thereby detaching the stub 21 from the upper recess 112 such that the blade 40 together with the control member 20 can be moved downwardly along the elongate slot 110 until the stub 21 is displaced to a position located adjacent to the lower recess 111 as shown in FIG. 4.

At the same time, the stub 21 is urged to be received into the lower recess 111 by means of the returning action of the biasing member 30, thereby positioning the blade 40 automatically and thereby fully expanding the blade 40.

It should be clear to those skilled in the art that further embodiments of the present invention may be made without departing from the scope and spirit of the present invention.

What is claimed is:

1. A tool assembly comprising:

a housing having two side walls each having an inner face and an outer face, a chamber defined in said housing and located between said two side walls, at least one of said two side walls of said housing having an elongate slot vertically defined therein and communicating with said chamber, an upper recess and a lower recess defined in upper and lower portions of said at least one side wall and each communicating with said elongate slot respectively;

a blade received in said chamber and mounted on the inner face of said at least one side wall, a bore transversely defined in said blade and communicating with said elongate slot;

a control member mounted on the outer face of said at least one side wall and slidable along said elongate slot, a stub formed on said control member and detachably received in one of said upper recess and said lower recess, a hole defined in said control member and aligning with said bore;

a substantially V-shaped biasing member received in said elongate slot and abutting between said blade and said control member, said biasing member including a pressing portion urged on said stub of said control member and an abutment rested on said at least one side wall in said elongate slot; and a positioning member extending through said hole, said biasing member, and said elongate slot, and securely engaged in said bore.

2. The tool assembly in accordance with claim 1, wherein said bore is defined by a threaded periphery in said blade.

3. The tool assembly in accordance with claim 1, wherein said abutment is arcuate in section.

4. The tool assembly in accordance with claim 1, wherein said housing has a base plate with a passage defined between said base plate and said at least one side wall and communicating with said chamber.

5. The tool assembly in accordance with claim 1, wherein each of said two side walls of said housing has a shoulder mounted on one side thereof and disposed perpendicularly to said side wall.

* * * * *